US006428394B1

(12) United States Patent
Mooring et al.

(10) Patent No.: US 6,428,394 B1
(45) Date of Patent: Aug. 6, 2002

(54) METHOD AND APPARATUS FOR CHEMICAL MECHANICAL PLANARIZATION AND POLISHING OF SEMICONDUCTOR WAFERS USING A CONTINUOUS POLISHING MEMBER FEED

(75) Inventors: Ben Mooring, Austin, TX (US); Wilbur Krusell, Palo Alto, CA (US); Glenn Travis, Sunnyvale, CA (US); Erik Engdahl, Livermore, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/541,144

(22) Filed: Mar. 31, 2000

(51) Int. Cl.[7] ..... B24B 1/00

(52) U.S. Cl. ..... 451/41; 451/59; 451/168; 451/164; 451/297; 451/307

(58) Field of Search ..... 451/59, 41, 36, 451/168, 164, 170, 173, 296, 297, 304–307

(56) References Cited

U.S. PATENT DOCUMENTS

| | | | | |
|---|---|---|---|---|
| 3,753,269 A | | 8/1973 | Budman | 15/160 |
| 4,318,250 A | | 3/1982 | Kilevoneit et al. | 51/134 |
| 4,720,939 A | | 1/1988 | Simpson et al. | 51/135 R |
| 4,934,102 A | | 6/1990 | Leach et al. | 51/50 |
| 5,081,051 A | | 1/1992 | Mattingly et al. | 437/10 |
| 5,335,453 A | | 8/1994 | Baldy et al. | 51/67 |
| 5,484,323 A | | 1/1996 | Smith | 451/10 |
| 5,536,202 A | | 7/1996 | Appel et al. | 451/285 |
| 5,547,417 A | | 8/1996 | Breivogel et al. | 451/58 |
| 5,558,568 A | | 9/1996 | Talieh et al. | 451/303 |
| 5,575,707 A | | 11/1996 | Talieh et al. | 451/173 |
| 5,593,344 A | | 1/1997 | Weldon et al. | 451/296 |
| 5,611,943 A | | 3/1997 | Cadien et al. | 216/88 |
| 5,622,526 A | | 4/1997 | Phillips | 451/72 |
| 5,643,044 A | | 7/1997 | Lund | 451/5 |
| 5,655,951 A | | 8/1997 | Meikle et al. | 451/56 |
| 5,692,947 A | | 12/1997 | Talieh et al. | 451/41 |
| 5,692,950 A | | 12/1997 | Rutherford et al. | 451/552 |
| 5,759,918 A | | 6/1998 | Hoshizaki et al. | 438/692 |
| 5,762,536 A | | 6/1998 | Pant et al. | 451/6 |
| 5,871,390 A | | 2/1999 | Pant et al. | 451/5 |
| 5,885,143 A | * | 3/1999 | Ichikawa et al. | 451/168 |
| 5,897,426 A | | 4/1999 | Somekh | 451/41 |
| 5,899,798 A | | 5/1999 | Trojan et al. | 451/259 |
| 5,908,530 A | | 6/1999 | Hoshizaki et al. | 156/345 |
| 5,913,716 A | * | 6/1999 | Mucci et al. | 451/59 |
| 5,958,794 A | | 9/1999 | Bruxvoort et al. | 438/692 |
| 6,001,004 A | * | 12/1999 | Botteghi | 451/168 |
| 6,068,542 A | * | 5/2000 | Hosokai | 451/168 |
| 6,179,709 B1 | * | 1/2001 | Redeker et al. | 451/168 |

FOREIGN PATENT DOCUMENTS

| | | |
|---|---|---|
| WO | WO 98/45090 | 10/1998 |
| WO | WO 99/22908 | 5/1999 |

* cited by examiner

*Primary Examiner*—Eileen P. Morgan
(74) *Attorney, Agent, or Firm*—Brinks Hofer Gilson & Lione

(57) ABSTRACT

A method and apparatus are disclosed for chemically-mechanically polishing and planarizing semiconductors. An apparatus includes first and second rollers connected by a tension belt. A polishing member is releasably attached to the first and second rollers. A method includes clamping a first portion of a continuous strip of polishing member to a first roller, clamping a second portion of the continuous strip to a second roller, applying a tension to the continuous strip and rotationally reciprocating the rollers while pressing a semiconductor wafer against the continuous strip.

19 Claims, 1 Drawing Sheet

METHOD AND APPARATUS FOR CHEMICAL MECHANICAL PLANARIZATION AND POLISHING OF SEMICONDUCTOR WAFERS USING A CONTINUOUS POLISHING MEMBER FEED

FIELD OF THE INVENTION

The present invention relates to polishing and planarization of semiconductor wafers. More particularly, the present invention relates to a method and apparatus for linearly reciprocating a portion of a continuous polishing member to process a semiconductor wafer.

BACKGROUND

Chemical mechanical planarization/polishing (CMP) techniques are used to planarize and polish each layer of a semiconductor wafer. Available CMP systems, commonly called wafer polishers, often use a rotating wafer carrier that brings the wafer into contact with a polishing pad rotating in the plane of the wafer surface to be planarized. A chemical polishing agent or slurry containing microabrasives and surface modifying chemicals is applied to the polishing pad to polish the wafer. The wafer holder then presses the wafer against the rotating pad and is rotated to polish and planarize the wafer. Some available wafer polishers use orbital motion, or a linear belt, rather than a rotating surface to carry the polishing head. One challenge faced in polishing semiconductor wafers using a disposable polishing pad on the available wafer polishers is that these polishers typically need to be frequently stopped to replace the polishing member after a limited number of uses. Accordingly, there is a need for a method and system of performing CMP that addresses this issue.

DETAILED DESCRIPTION OF THE PRESENTLY PREFERRED EMBODIMENTS

In order to address the drawbacks of the prior art described above, a wafer polisher is disclosed below that provides a compact device for planarization and polishing of semiconductor wafers. The embodiment discussed below also provides for efficient usage of disposable polishing media and minimizes wafer polisher downtime that results from the need to replace used polishing media.

Figure 1:
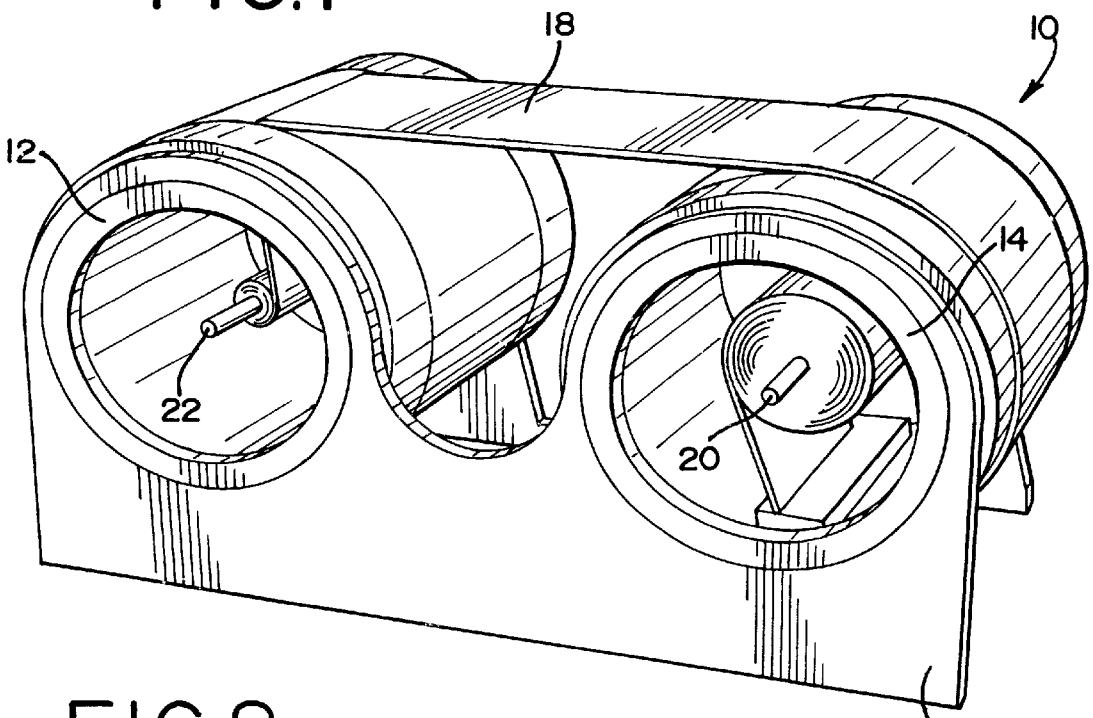
FIG. 1 is a perspective view of a semiconductor wafer-polishing device according to a preferred embodiment.

A preferred embodiment of a wafer polisher 10 is illustrated in FIG. 1. The polisher 10 includes a first rotatable drum 12 that is adjacent a second rotatable drum 14, wherein each of the rotatable drums 12, 14 are positioned along parallel axes of rotation within a frame 16. A polishing member 18 extends between the first and second rotatable drums 12, 14. The polishing number 18 is preferably a portion of a continuous strip of polishing material that begins at a polishing member supply roller 20 located within the second rotatable drum 14 and terminates at a polishing member take-up roller 22 positioned within the first rotatable drum 12. In a preferred embodiment, the polishing member preferably comprises a fixed abrasive material. Any of a number of known affixed abrasive materials, such as the structured abrasive belts available under part numbers 3M 307EA or 3M 237AA from 3M Corporation of St. Paul, Minn., may be utilized. In other embodiments, the polishing member 18 may be a polishing pad configured to receive an abrasive slurry for use in polishing a semiconductor wafer.

Figure 2:
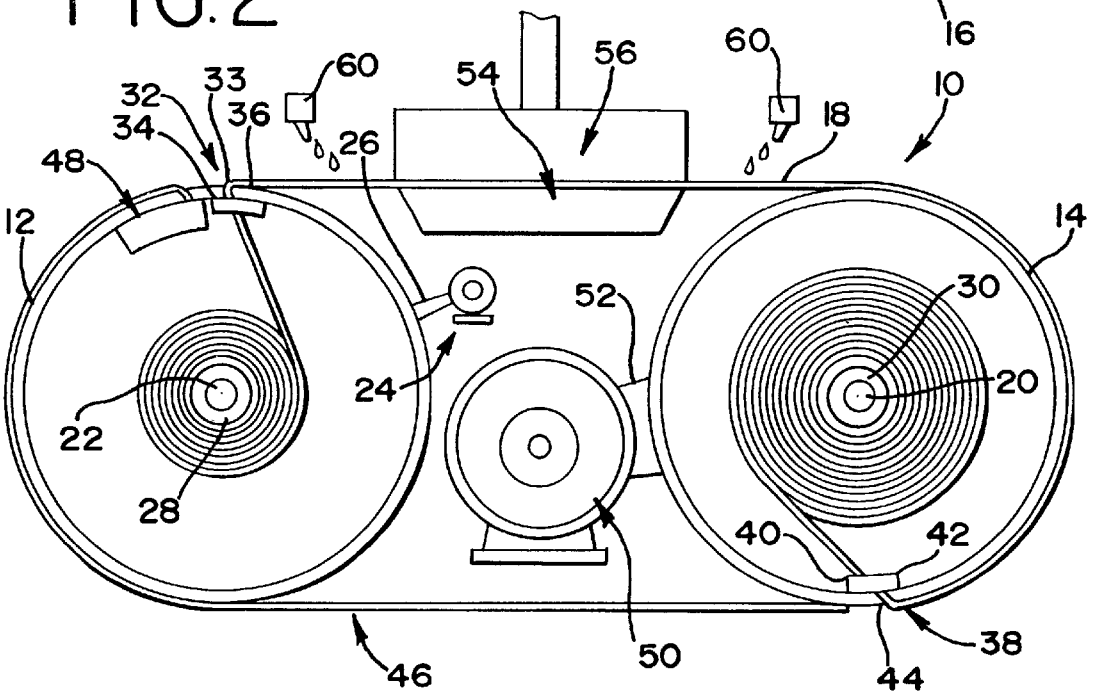
FIG. 2 is a side sectional view of the semiconductor wafer-polishing device of FIG. 1.

A more detailed view of the polishing apparatus of FIG. 1 is shown in FIG. 2. As shown in FIG. 2, the polishing member take-up roller 22 is preferably driven by a feed roller motor 24 via a belt 26. The feed roller motor 24 may be any of a number of commonly known DC motors. Preferably, the polishing member take-up roller 22 is independently rotatable from the first rotatable drum 12. Similarly, the polishing member feed roller 20 is preferably independently rotatable from the second rotatable drum 14. Also as shown in FIG. 2, each of the polishing member take-up roller 22 and feed roller 20 include a respective drum clutch 28, 30, adjustable to releasably connect the polishing member take-up roller and feed roller to the first rotatable drum 12 and second rotatable drum 14, respectively. The drum clutch 28, 30 may be any of a number of standard electrically operable clutches.

The polishing member 18 is preferably releasably clamped by a first clamping mechanism 32 positioned on the first rotatable drum 12. As shown in FIG. 2, an opening 33 in the circumference of the first rotatable drum 12 is flanked by first and second portions 34, 36 of the clamping mechanism 32. In one embodiment, the clamping mechanism 32 may have a first portion 34 that is fixed and a second portion 36 that is movable into and out of engagement with the first portion to capture a segment of the polishing member between the first and second portions 34, 36. Similarly, the second rotatable drum 14 includes a clamping mechanism 38 having first and second portions 40, 42 positioned adjacent an opening 44 in the second rotatable drum 14. Again, the first portion 40 of the clamp 38 is preferably fixed while the second portion 42 is movably engageable with the first portion. Both of the clamps 32, 38 may be electrically, pneumatically, or hydraulically operable. Additionally, the different portions of the clamps 32, 38 may have complementary protrusions and receiving areas to enhance the gripping capability of the clamp on the polishing member. Although the clamps preferably span the entire width of the polishing member, the clamps may have a width less than that of the polishing member in other embodiments, or may include a serrated edge that engages the polishing member.

In order to maintain a suitable tension on the polishing member 18, a tensioning belt 46 is preferably fixedly attached to the second rotatable drum 14 and extends around the outer circumference of the first rotatable drum 12 where the end of the tensioning belt is attached to a tensioning mechanism 48 connected to the first rotatable drum 12. The tensioning belt 46 is preferably chosen to have a length that permits the drums to rotate a portion of one revolution. In one embodiment, the tensioning mechanism 48 includes a spool-type mechanism that can controllably tighten or loosen the tensioning belt to adjust the tension of the polishing member 18 clamps between the rollers 12, 14. Although the tensioning mechanism 48 and clamps 32, 38 are shown as mounted on the internal circumference of the drums 12, 14, they may be mounted internally or externally to the rotatable drums.

A drum drive motor 50 is preferably connected to at least one of the rotatable drums 12, 14 by a belt 52. The drum drive motor 50 is operable to rotationally reciprocate the drums 12, 14 to provide a linear reciprocating motion to the polishing member 18. Preferably, the drum drive motor is configured to rotate the drum only a portion of a rotation in either direction. A platen assembly 54 is preferably positioned underneath the polishing member 18 opposite the portion of the polishing member intended to contact a semiconductor wafer. The platen may be adjustable to accommodate and adjust for differences in planarity between the platen surface and the polishing member. In addition, the surface of the platen assembly directly opposite the backside of the polishing member is preferably configured to provide a fluid bearing underneath the polishing member. A suitable platen assembly 54 is a platen assembly supplied with the TERES™ polisher manufactured by Lam Research Corporation of Fremont, Calif.

Referring to the apparatus described above, a preferred method of operating a polishing module will be described below. In one embodiment, each wafer polished on the apparatus of FIGS. 1 and 2 is preferably treated with a new portion of polishing material. After a strip of polishing member is attached to the polishing member take-up roller and mounted on the feed roller within each of the respective first and second rotatable drums 12, 14, the clamps 32, 38 are engaged to grip the ends of the polishing member extending through the drums. The tension mechanism 48 is engaged to apply tension to the tensioning belt 46, which in turn provides tension to the polishing member 18. Also, the drum clutches are engaged to ensure the take-up and feed rollers for the polishing member cannot rotate relative to the drums while wafer polishing his taking place.

After the polishing member is secured and tension applied, the drum drive motor 50 operates to rotationally reciprocate the drums 12, 14 so that the drums partially rotate back and forth at a predetermined frequency. Although various oscillation frequencies may be implemented, the frequency of oscillation is preferably in the range of 0.25 to 2.0 Hertz. When the drum drive motor rotationally reciprocates the drums, the polishing member 18 is moving back and forth in a linear direction. A wafer is preferably lowered against the polishing member 18 opposite the support platen assembly 54. In one preferred embodiment, the pair of rotatable drums oscillates back and forth such that each drum rotates less than 180 degrees during each cycle of the oscillation. The length of the stroke, the frequency of the oscillation, the material tension, and other process parameters may all be adjusted to accommodate a particular type of wafer based on the type of fixed abrasive material and/or for the type of wafer being processed. In one embodiment, the length of the tensioning belt may be greater than the length of polishing member positioned outside of the drums. In other embodiments, the polisher may be configured such that the tensioning belt is less than, or equal to, the length of the polishing member positioned outside of the drums.

The semiconductor wafer is preferably mounted on a wafer carrier and spindle drive assembly 56. Any commonly used wafer carrier head and spindle drive assembly, such as those used in the TERES™ polisher from Lam Research Corporation of Fremont, Calif., may be used to provide pressure on the wafer against the polishing member 18. Also, the wafer may be rotationally turned in place while pressed against the polishing member to increase the uniformity of the polish step. Although not required, the polisher 10 described herein may utilize a non-abrasive liquid during polishing, such as deionized water, to facilitate the polishing process. The non-abrasive liquid may be applied via nozzles 60 to the region of the polishing member intended for contact with a wafer. After the desired amount of material or non-uniformity has been removed from the wafer, the wafer is removed from contact with the polishing member 18 by raising the spindle assembly and wafer carrier. The polishing member is then released by the clamps 32, 38 and the tension on the tension belt 46 is released by the tensioning mechanism 48. The drum drive motor 50 locks the drums 12 and 14 in place so that the polishing member drive motor 26 can move used polishing member onto the polishing member take-up roller 22. The new polishing member is drawn from the polishing member feed roller 20 as the drum clutches release and allow independent motion of the take-up and feed rollers with respect to the drums. Following a complete replacement of the used polishing member 18 with fresh polishing member material, the clamps 32, 38 are engaged and the tension mechanism 48 again applies tension to the tensioning belt 46. Also, the drum clutches are again engaged. The next wafer is then treated by reciprocating the drum rollers about their axis to provide linear polishing motion. These steps are then repeated for each subsequent wafer.

In some embodiments, the abrasive surface of the polishing member may be used up prior to completing the processing of a wafer. In these instances, the same steps described above for replenishing a fresh supply of fixed abrasive polishing member would be executed, however the wafer would not be exchanged for a different wafer until after the polish process is completed. In other embodiments, only a portion of unused polishing member is drawn out after each use so that a portion of used polishing member is applied to subsequent wafers.

As described above, an apparatus and method for chemically mechanically polishing a semiconductor wafer with a fixed abrasive polishing member has been provided. A preferred embodiment of the invention, a pair of rotatable drums is provided that oscillates back and forth such that each drum rotates less than 180 degrees during each cycle of the oscillation. This causes the fixed abrasive polishing member to be moved under a wafer in a linear motion. The length of the stroke, the frequency of the oscillation, the material tension, and other process parameters may all be adjusted to accommodate a particular type of wafer based on the type of fixed abrasive material and/or for the type of wafer being processed. An advantage of the presently preferred embodiment is that a significant supply of polishing material may be stored within the polisher to provide a polisher having a small footprint roller and requiring less down time to replace used polishing member.

It is intended that the foregoing detailed description be regarded as illustrative rather than limiting, and that it be understood that the following claims, including all equivalents, are intended to define the scope of this invention.

We claim:

1. An apparatus for chemically mechanically polishing a semiconductor wafer comprising:

a first roller;

a second roller positioned adjacent the first roller;

a tension belt adjustably connected at a first end to the first roller and connected at a second end to the second roller; and a polishing member having a first portion releasably attached to the first roller and a second portion releasably attached to the second roller such that the polishing member is not in surface contact with the tension belt, wherein the first and second rollers are rotatable to provide for a linear reciprocating motion of the polishing member.

2. The apparatus of claim 1, wherein the polishing member comprises a fixed abrasive.

3. The apparatus of claim 1, wherein the polishing member comprises a non-fixed abrasive polishing pad configured to receive an abrasive slurry.

4. The apparatus of claim 1, further comprising a polishing member supply mounted on a polishing member supply roll positioned inside the second roller and a polishing member take-up roller positioned inside the first roller, wherein the polishing member comprises a continuous portion of the polishing member supply.

5. The apparatus of claim 1 wherein the first end of the tension belt is connected to the first roller at a tension mechanism connected to the first roller, wherein the tension mechanism is configured to provide a tension on the tension belt.

6. The apparatus of claim 4 further comprising a first abrasive brake connected to the first roller for releasably gripping a first portion of the polishing member and a second abrasive brake connected to the second roller for releasably gripping a second portion of the polishing member.

7. The apparatus of claim 1 further comprising a roller motor operatively connected to at least one of the first and second rollers, wherein the roller motor is configured to rotationally reciprocate the first and second rollers a portion of one rotation of the rollers.

8. The apparatus of claim 1 further comprising a polishing member support positioned between the first and second rollers and under a backside of the polishing member.

9. The apparatus of claim 8 wherein the polishing member support comprises a platen configured to provide a fluid bearing to support the backside of the polishing member, whereby the fluid bearing supports the polishing member while a semiconductor wafer is polished by the polishing member.

10. An apparatus for polishing a semiconductor wafer comprising:

a polishing member comprising a fixed abrasive releasably attached to each of a first and a second roller, wherein the first and second rollers are reciprocally rotatable about substantially parallel axes of rotation; and a tension strap connected to the first and second rollers and in contact with a portion of the outer circumference of at least one of the first and second rollers, wherein the tension strap connects to the first roller via a tensioning mechanism configured to maintain a tension on the tension strap and simultaneously maintain a tension on the polishing member, and wherein the tension strap is not in surface contact with the polishing member.

11. The apparatus of claim 10 wherein the polishing member comprises a portion of a continuous strip, and wherein the continuous strip is releasably connected to the first roller by a first clamping device and connected to the second roller by a second clamping device.

12. The apparatus of claim 10 further comprising a polishing member supply positioned inside the second roller, wherein the polishing member comprises a continuous portion of the polishing member supply.

13. The apparatus of claim 12 further comprising a polishing member take-up roller positioned inside the first roller, the polishing member take-up roller configured to hold used polishing member that is continuously connected with the polishing member.

14. The apparatus of claim 13 further comprising a polishing member feed motor operatively connected with the polishing member take-up roller and a roller motor operatively connected with the second roller, the apparatus comprising:

a first mode of operation wherein the roller motor maintains the first and second rollers in a fixed rotational position and the polishing member feed motor moves a fresh supply of polishing member between the first and second rollers; and a second mode of operation wherein a drum clutch connected with each of the first and second rollers maintains the polishing member supply roller and polishing member take-up roller in a rotationally synchronous position with respect to the first and second rollers while the roller motor rotationally reciprocates the first and second rollers.

15. The apparatus of claim 14, wherein the polishing member comprises a fixed abrasive material.

16. A method of using a continuous polishing member feed device to polish a semiconductor wafer, the method comprising:

clamping a first portion of a continuous strip of polishing member to a first rotatable roller;

clamping a second portion of the continuous strip of polishing member to a second rotatable roller;

applying a tension to the continuous strip of polishing member by providing a tension to a tensioning belt having a first end connected with the first roller and a second end connected with the second roller; and rotationally reciprocating the first and second rotatable rollers while pressing a semiconductor wafer against the continuous strip of polishing member.

17. The method of claim 16 further comprising:

releasing the first portion of the continuous strip of polishing member clamped to the first rotatable roller;

releasing the second portion of the continuous strip of polishing member clamped to the second rotatable roller;

drawing out a fresh supply of the continuous strip of polishing member from a polishing member supply disposed within the first rotatable roller and drawing a used portion of the continuous strip of polishing member into the second rotatable roller.

18. The method of claim 17 further comprising preventing rotation of the first and second rotatable rollers while drawing out a fresh supply of the continuous strip of polishing member.

19. The method of claim 18 further comprising re clamping the continuous strip of polishing member to the first roller and the second roller, reapplying a tension to the tensioning belt and rotationally reciprocating the strip of polishing member.

* * * * *

UNITED STATES PATENT AND TRADEMARK OFFICE

CERTIFICATE OF CORRECTION

PATENT NO. : 6,428,394 B1
DATED : August 6, 2002
INVENTOR(S) : Ben Mooring et al.

It is certified that error appears in the above-identified patent and that said Letters Patent is hereby corrected as shown below:

Title page,
Item [56], U.S. PATENT DOCUMENTS, delete “Kilevoneit” and substitute -- Klievoneit -- in its place.

Column 6,
Lines 52-53, delete “re clamping” and substitute -- reclamping -- in its place.

Signed and Sealed this

Twenty-fifth Day of February, 2003

JAMES E. ROGAN
*Director of the United States Patent and Trademark Office*